US006056794A

United States Patent [19]

Stoetzel et al.

[11] Patent Number: 6,056,794

[45] Date of Patent: May 2, 2000

[54] ABRASIVE ARTICLES HAVING BONDING SYSTEMS CONTAINING ABRASIVE PARTICLES

[75] Inventors: William L. Stoetzel, Lakeland; Ronald D. Provow, Woodbury, both of Minn.

[73] Assignee: 3M Innovative Properties Company, St. Paul, Minn.

[21] Appl. No.: 09/264,386

[22] Filed: Mar. 5, 1999

[51] Int. Cl.[7] ..... B24D 3/00; B24D 3/34; B24D 11/02

[52] U.S. Cl. ..... 51/295; 51/297; 51/298; 51/309; 51/307

[58] Field of Search ..... 51/295, 297, 298, 51/309, 307

[56] References Cited

U.S. PATENT DOCUMENTS

| | | | |
|---|---|---|---|
| 1,910,444 | 5/1933 | Nicholson . | |
| 3,041,156 | 6/1962 | Rowse et al. . | |
| 4,255,164 | 3/1981 | Butzke et al. . | |
| 4,311,489 | 1/1982 | Kressner . | |
| 4,314,827 | 2/1982 | Leitheiser et al. . | |
| 4,623,364 | 11/1986 | Cottringer et al. . | |
| 4,652,275 | 3/1987 | Bloecher et al. | 51/298 |
| 4,744,802 | 5/1988 | Schwabel . | |
| 4,751,138 | 6/1988 | Tumey et al. . | |
| 4,770,671 | 9/1988 | Monroe et al. . | |
| 4,799,939 | 1/1989 | Bloecher et al. . | |
| 4,871,376 | 10/1989 | DeWald | 51/298 |
| 4,881,951 | 11/1989 | Wood et al. . | |
| 4,950,696 | 8/1990 | Palazotto et al. . | |
| 4,985,340 | 1/1991 | Palazzotto et al. . | |
| 4,997,461 | 3/1991 | Markhoff-Matheny et al. . | |
| 5,009,675 | 4/1991 | Kunz et al. . | |
| 5,011,508 | 4/1991 | Wald et al. . | |
| 5,042,991 | 8/1991 | Kunz et al. . | |
| 5,085,671 | 2/1992 | Martin et al. . | |
| 5,213,591 | 5/1993 | Celikkaya et al. . | |
| 5,256,170 | 10/1993 | Harmer et al. . | |
| 5,304,224 | 4/1994 | Harmon | 51/297 |
| 5,316,812 | 5/1994 | Stout et al. | 51/298 |
| 5,417,726 | 5/1995 | Stout et al. . | |
| 5,500,273 | 3/1996 | Holmes et al. . | |
| 5,549,962 | 8/1996 | Holmes et al. | 51/298 |
| 5,551,961 | 9/1996 | Engen et al. | 51/298 |
| 5,573,619 | 11/1996 | Benedict et al. . | |
| 5,609,706 | 3/1997 | Benedict et al. . | |
| 5,641,330 | 6/1997 | Celikkaya et al. | 51/295 |
| 5,700,302 | 12/1997 | Stoetzel et al. | 51/298 |
| 5,766,277 | 6/1998 | DeVoe et al. | 51/298 |
| 5,851,247 | 12/1998 | Stoetzel et al. . | |

*Primary Examiner*—Michael Marcheschi
*Attorney, Agent, or Firm*—Scott A. Bardell

[57] ABSTRACT

This invention provides an abrasive article comprising abrasive agglomerate particles and a bond system. The abrasive agglomerate particles comprise a plurality of abrasive grains bonded together by means of a first binder. The abrasive agglomerate particles can be bonded to a backing by means of a first bond system. The first bond system comprises a second binder and a plurality of hard, inorganic particulates dispersed therein. A second bond system may be applied over the abrasive agglomerate particles. The second bond system comprises a third binder and a plurality of hard inorganic particulates dispersed therein. The bond systems of the invention are generally made by combining at least a curable binder precursor with hard, inorganic particulates. The invention also provides methods of making and using the above abrasive articles.

24 Claims, 2 Drawing Sheets

ABRASIVE ARTICLES HAVING BONDING SYSTEMS CONTAINING ABRASIVE PARTICLES

BACKGROUND OF THE INVENTION

This invention relates to an abrasive article comprising abrasive agglomerate particles and a bond system.

Abrasive articles have been used to refine or abrade the outer surface of a workpiece. In some instances this refining process abrades large amounts of material, for example, in high pressure grinding for removing gates from metal castings. In other instances, this refining process generates extremely fine surface finishes as in the case of polishing such a metal casing. Thus, abrading processes can range anywhere from cutting to polishing.

There is generally one common thread amongst all types of abrasive articles and abrading processes. This common thread is the inverse relationship between cut rates and surface finish. The ideal abrasive article will provide high cut rates (i.e., material removal rates) and will simultaneously generate a fine surface finish on the workpiece being abraded. Generally, however, abrasive articles that tend to generate high cut rates tend to also generate coarse surface finishes. Likewise, in general, abrasive articles that tend to generate finer surface finishes tend to also generate lower cut rates.

Typically, coated abrasives have either one or two layers of abrasive grains bonded to the backing and these abrasive grains are usually oriented to provide optimum cut rates. However, with only one or two layers of abrasive grains, the product life of a coated abrasive may not be as long as desired. In recent years, attempts have been made to increase the life of coated abrasives by bonding abrasive agglomerates to a backing. These abrasive agglomerates comprise a plurality of abrasive grains bonded together by a binder to form an agglomerate particle. These agglomerate particles are then bonded to the backing. Since these agglomerate particles are essentially three dimensional, they provide many "layers" of abrasive grains that can participate during grinding. In some instances, coated abrasives with agglomerate particles may provide longer life.

SUMMARY OF THE INVENTION

This invention provides an abrasive article comprising abrasive agglomerate particles and a bond system. The abrasive agglomerate particles comprise a plurality of abrasive grains bonded together by means of a first binder. The abrasive agglomerate particles can be bonded to a backing by means of a first bond system. The first bond system comprises a second binder and a plurality of hard, inorganic particulates dispersed therein. A second bond system may be applied over the abrasive agglomerate particles. The second bond system comprises a third binder and a plurality of hard inorganic particulates dispersed therein. The bond systems of the invention are generally made by combining at least a curable binder precursor with hard, inorganic particulates. It is to be understood that the terms "make coat", "binder", and "bond system" refer to cured or hardened resin systems that are formed from curable make coat precursors, binder precursors, and curable bond systems.

In one preferred aspect of the invention, the average particle size of the abrasive grains used in the abrasive agglomerates is essentially the same as the average particle size of the inorganic particulates.

Unexpectedly, this combination provides a coated abrasive article that generates relatively high cut rates with relatively fine surface finishes. Likewise, the abrasive article of the invention is quite long lasting. In addition, the hard, inorganic particulates enhance the cutting ability of the abrasive agglomerate. Since the inorganic particulates have essentially the same particle size as the abrasive grains in the abrasive agglomerate, the resulting coated abrasive article generates a relatively fine surface finish.

In one aspect, the abrasive article of the invention comprises:

a backing having a front and back surface;

a bond system which comprises a second binder and a plurality of hard, inorganic particulates dispersed in the second binder; and a plurality of discrete abrasive agglomerate particles bonded to the front surface of the backing by means of the bond system, wherein the abrasive agglomerate particles comprise a plurality of individual abrasive grains bonded together by means of a first binder, and wherein the average particle size of the abrasive grain is essentially the same size as the average particle size of the hard, inorganic particulates.

In another aspect of the invention, the abrasive article comprises:

a backing having a front and back surface;

a make coat bonded to the front surface of the backing;

a plurality of discrete abrasive agglomerate particles bonded to the front surface of the backing by the make coat, wherein the abrasive agglomerate particles comprise a plurality of individual abrasive grains bonded together by means of a first binder; and a bond system applied over the abrasive agglomerates, wherein the bond system comprises a second binder and a plurality of hard, inorganic particulates dispersed in the second binder, wherein the average particle size of the abrasive grain is essentially the same size as the average particle size of the hard, inorganic particulates.

In another aspect, the abrasive article of the invention comprises:

a backing having a front and back surface;

a plurality of discrete abrasive agglomerate particles bonded to the front surface of the backing, wherein the abrasive agglomerate particles comprise a plurality of individual abrasive grains bonded together by means of a first binder;

a first bond system that bonds the abrasive agglomerates to the front surface of the backing, wherein the first bond system comprises a second binder and a plurality of hard, inorganic particulates dispersed in the second binder; and a second bond system applied over the abrasive agglomerates, wherein the second bond system comprises a third binder and a plurality of hard, inorganic particulates dispersed in the third binder, and wherein the average particle size of the abrasive grain is essentially the same size as the average particle size of the hard, inorganic particulates.

In another aspect, the invention provides a method of making an abrasive article comprising the steps of:

placing a make coat precursor on a surface of a backing;

placing discreet abrasive agglomerate particles onto the make coat precursor, the abrasive agglomerate particles comprising a plurality of individual abrasive grains bonded together by means of a first binder;

applying a bond system precursor over the abrasive agglomerate particles, said bond stem comprising a plurality of hard inorganic particulates dispersed in a second binder precursor; and curing the make coat and second bond precursor.

In another aspect, the invention provides a method of abrading a surface of a workpiece comprising the steps of:

frictionally contacting a surface of an abrasive article with a surface of the workpiece, the abrasive article comprising a backing having a front and back surface;

a plurality of discrete abrasive agglomerate particles bonded to the front surface of the backing, wherein the abrasive agglomerate particles comprise a plurality of individual abrasive grains bonded together by means of a first binder; and a bond system that bonds the abrasive agglomerate particles to the front surface of the backing, wherein the bond system comprises a second binder and a plurality of hard, inorganic particulates dispersed in the second binder, and wherein the average particle size of the abrasive grain is essentially the same size as the average particle size of the hard, inorganic particulates.

The shape of the abrasive agglomerate particle may be precise or irregular and random. Precisely shaped abrasive agglomerate particles can be any three dimensional shape such as a pyramid, cone, block, cube, sphere, cylinder, and the like. Any combination of shapes of abrasive agglomerate particles may be used in the abrasive articles of the invention.

DETAILED DESCRIPTION OF THE INVENTION

Figure 1:
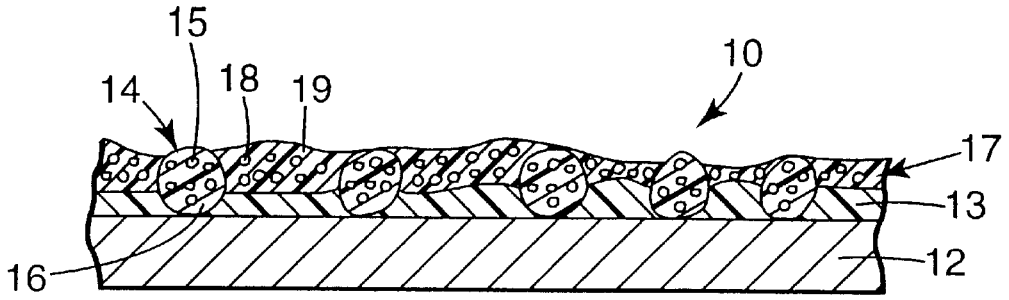
FIG. 1 is a cross-sectional view of an embodiment of the abrasive article of the invention wherein the discrete abrasive agglomerate particles have a random shape and have a bond system applied over the abrasive agglomerate particles.

FIG. 1 shows one embodiment of an abrasive article of the invention. Abrasive article 10 comprises a backing 12 with a make coat 13 thereon. A plurality of discrete abrasive agglomerate particles 14 are partially embedded in the make coat 13 and bonded to the backing 12. The abrasive agglomerate particles 14 comprise abrasive grains 15 bonded together by means of a first binder 16. The abrasive agglomerate particles 14 are partially covered (sized) with a bond system 17 which comprises a plurality of inorganic abrasive particulates 18 dispersed within a second binder 19. It is preferred that the plurality of abrasive agglomerate particles are singular and discrete abrasive particles bonded to a backing in a random fashion.

Figure 2:
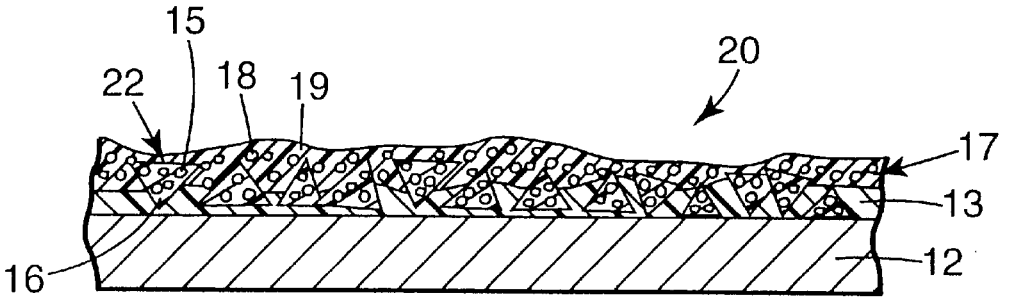
FIG. 2 is a cross-sectional view of another embodiment of the abrasive article of the invention wherein the discrete abrasive agglomerate particles have a precise shape and have a bond system applied over the abrasive agglomerate particles.

FIG. 2 shows an abrasive article 20 of the invention having essentially the same construction as the abrasive article of FIG. 1, except the abrasive agglomerate particles 22 are precisely shaped.

Figure 3:
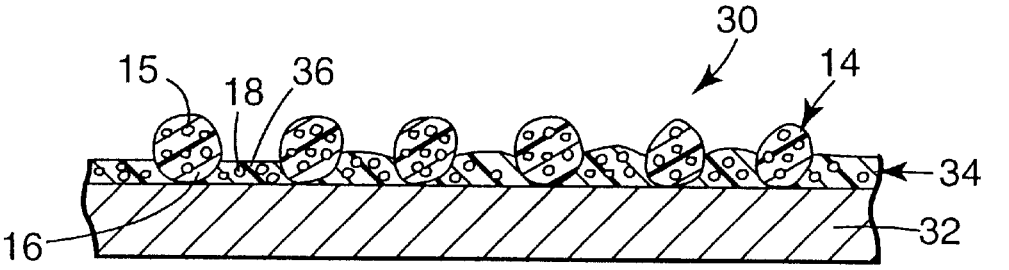
FIG. 3 is a cross-sectional view of another embodiment of the abrasive article of the invention wherein the discrete abrasive agglomerate particles have a random shape and are bonded to a backing with a bond system.

FIG. 3 illustrates another embodiment of the abrasive article of the invention. Abrasive article 30 comprises a backing 32 with a plurality of discrete abrasive agglomerate particles 14 partially embedded in a bond system 34. The bond system 34 comprises a plurality of inorganic abrasive particulates 18 dispersed within a second binder 36. As in FIG. 1, the abrasive agglomerate particles comprise abrasive grains 15 bonded together by means of a first binder 16.

Figure 4:
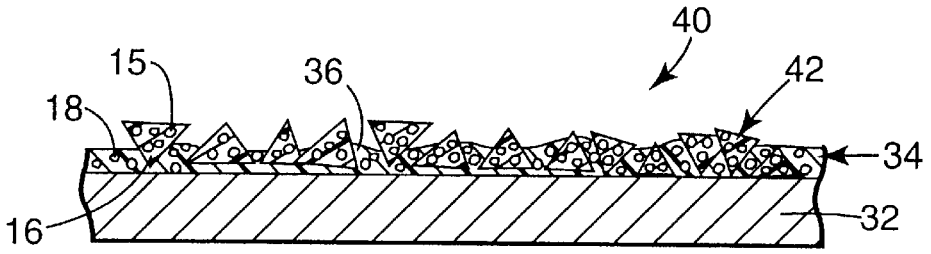
FIG. 4 is a cross-sectional view of another embodiment of the abrasive article of the invention wherein the discrete abrasive agglomerate particles have a precise shape and are bonded to a backing with a bond system.

FIG. 4 shows an abrasive article 40 of the invention having essentially the same construction as the abrasive article of FIG. 3, except the abrasive agglomerate particles 42 are precisely shaped.

Figure 5:
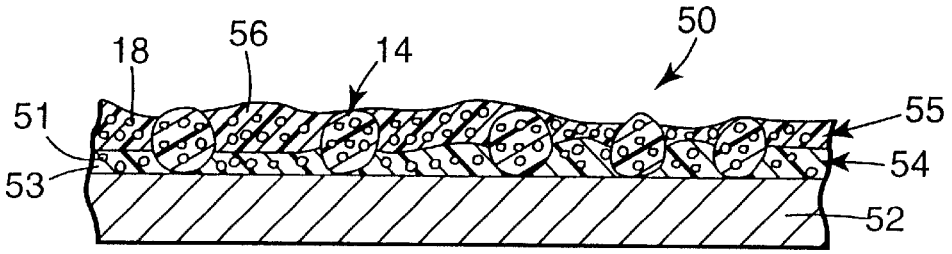
FIG. 5 is a cross-sectional view of another embodiment of the abrasive article of the invention wherein the discrete abrasive agglomerate particles have a random shape and are bonded to a backing with a first bond system and a second bond system is applied over the abrasive agglomerate particles.

FIG. 5 shows an abrasive article of the invention 50 having discrete abrasive agglomerate particles 14 bonded to a backing 52 by means of a first bond system 54. The first bond system 54 comprises a plurality of inorganic abrasive particulates 51 dispersed within a second binder 53. A second bond system 54 has been applied over the abrasive agglomerate particles 14. The second bond system 55 comprises a plurality of inorganic abrasive particulates 18 dispersed within a third binder 56. The first and second bond systems may comprise the same or different binder and inorganic particulate.

Figure 6:
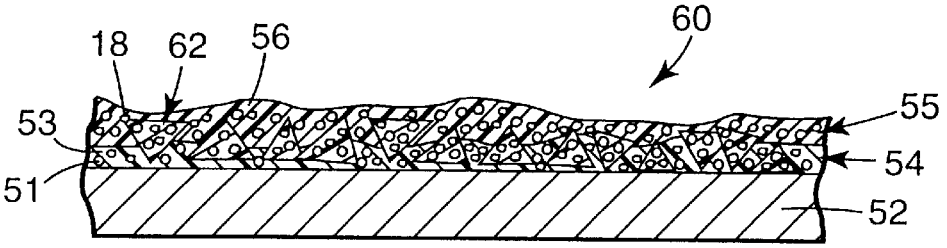
FIG. 6 is a cross-sectional view of another embodiment of the abrasive article of the invention wherein the discrete abrasive agglomerate particles are precisely shaped and are bonded to a backing with a first bond system and a second bond system is applied over the abrasive agglomerates.

FIG. 6 shows an abrasive article 60 of the invention having essentially the same construction as the abrasive article of FIG. 5 except that the abrasive agglomerate particles 62 are precisely shaped. Of course, the abrasive articles of the invention may also comprise a combination of randomly and precisely shaped abrasive agglomerate particles.

Figure 7:
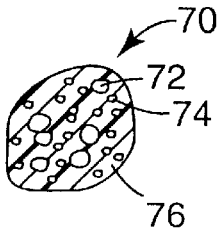
FIG. 7 is a cross sectional view of an abrasive agglomerate particle of the invention wherein the individual abrasive grains have two different particle sizes.

FIG. 7 shows a preferred abrasive agglomerate particle 70 comprising abrasive grains 72 and 74 dispersed and bonded within a first binder 76. Abrasive grain 72 has a larger mean particle size than that of abrasive grain 74.

The abrasive grains 15 and the inorganic particulates 18 may be compositionally different or may be the same. In some embodiments of the invention, the abrasive grains 15 and the inorganic abrasive particulates 18 may be essentially the same compositionally. For example, both the abrasive grains in the abrasive agglomerate particles and the inorganic abrasive particulates both are alumina. The alumina used in both cases may be either fused alumina or alumina derived from a sol gel process. In another example, the abrasive grains may be alumina and the inorganic particulates may be silicon carbide or vice versa.

It is also preferred that the average or mean particle size of the abrasive grain 15 is essentially the same as the mean particle size of the inorganic abrasive particulates 18. As used herein, the term "essentially the same" when referring to mean particle size means that the average particle size of the abrasive grain and the inorganic particulate is within about 25 percent of each other, preferably within about 20 percent, more preferably within 15 percent, even more preferably within 10 percent, and even more preferably within 5 percent of each other. The average particle size of the abrasive grains and particles may be measured by any conventional technique such as screen analysis, electrical resistance methods, and the like.

Preferred binders for use in the bond systems of the invention include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

Backing

A variety of backing materials are suitable for the abrasive article of the present invention, including both flexible backings and backings that are more rigid. Examples of typical flexible abrasive backings include polymeric film, primed polymeric film, metal foil, cloth, paper, vulcanized fiber, nonwovens and treated versions thereof, and combinations thereof. The thickness of a backing generally ranges between about 20 to 5,000 $\mu$m and preferably between 50 to 2,500 $\mu$m.

Examples of more rigid backings include metal plates, ceramic plates, and the like. Another example of a suitable backing is described in U.S. Pat. No. 5,417,726 (Stout et al.), incorporated herein by reference. The backing may also consist of two or more backings laminated together, as well as reinforcing fibers engulfed in a polymeric material as disclosed in U.S. Pat. Nos. 5,573,619 and 5,609,706 (Benedict et al.), incorporated herein by reference.

One preferred backing is a treated cloth backing. The cloth may comprise cloths of polyester, nylon, cotton, rayon, and the like. The cloth may be woven or stitch bonded and may be treated with various coatings to seal the cloth and modify the physical properties of the cloth as needed.

Abrasive Agglomerates

The abrasive agglomerates of the invention comprise single abrasive grains bonded together with a binder. The binder comprises a binder precursor that has been cured. The abrasive agglomerate particles of the invention may utilize abrasive grains that are identical or are different than the inorganic particulates and may utilize abrasive grains that have different mean particle sizes as shown in FIG. 7.

The randomly shaped abrasive agglomerates of the invention may range in size from about 150 $\mu$m to about 3,000 $\mu$m in largest dimension. The precisely shaped abrasive agglomerate particles of the invention preferably have no dimension greater than 2,500 $\mu$m. The preferred size range of the precisely shaped agglomerate particles ranges from 25 to 1,500 $\mu$m, and more preferably from 50 to 500 $\mu$m.

In some instances, the abrasive agglomerate particles may contain both "coarse" abrasive grains and "fine" abrasive grains. The blending of two different particle sizes of abrasive grains within an abrasive agglomerate particle results in a reinforced binder-abrasive composite. The term "differently sized" when referring to individual abrasive grains means that each particle has a distinct particle size distribution which is evidenced by two distinct bell curves. The blending of particles having two different particle size distributions is further described in co-assigned U.S. application Ser. No. 08/987,496, filed Dec. 9, 1997, now allowed, entitled "ABRASIVE SLURRIES AND ABRASIVE ARTICLES COMPRISING MULTIPLE ABRASIVE PARTICLE GRADES ", incorporated herein by reference. When determining the average particle size of an abrasive agglomerate particle containing particles having different sizes, the mean particle size is based upon the particles having the largest particle size distribution only. Preferred abrasive grains for use in the abrasive agglomerates include fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, zirconia, titania, silicates, tin oxide, cubic boron nitride, garnet, fused alumina zirconia, sol gel process derived alumina abrasive particles, and the like.

Abrasive grains can be coated with materials to provide the particles with desired characteristics. For example, materials applied to the surface of an abrasive grain have been shown to improve the adhesion between the abrasive grain and the binder. Additionally, a material applied to the surface of an abrasive grain may improve the dispersibility of the abrasive grains in the binder precursor. Alternatively, surface coatings can alter and improve the cutting characteristics of the resulting abrasive grain. Such surface coatings are described, for example, in U.S. Pat. Nos. 5,011,508 (Wald et al.); 1,910,444 (Nicholson); 3,041,156 (Rowse et al.); 5,009,675 (Kunz et al.); 4,997,461 (Markhoff-Matheny et al.); 5,213,951 (Celikkaya et al.); 5,085,671 (Martin et al.); and 5,042,991 (Kunz et al.), the disclosures of which are incorporated herein by reference.

The binders used in the abrasive agglomerate particles of the invention may be the same or different than the binders used in the bonding system. The useful binders include those binders and binder precursors described as being useful in the bond systems of the invention. Preferred binders for use in the abrasive agglomerate particles include those that are capable of being cured by radiation energy or thermal energy.

The abrasive agglomerate particle may also have a precise shape as shown in FIGS. 2, 4, and 6. Examples of such precise shapes include rods, triangles, pyramids, cones, solid spheres, hollow spheres, and the like. Alternatively, the abrasive particle may be randomly shaped.

Generally, the abrasive agglomerates of the invention are comprised of about 10 to 90 parts by weight binder and about 90 to 10 parts by weight abrasive grains. Preferably, the abrasive agglomerates of the invention comprise about 30 to 70 parts by weight binder and about 70 to 30 parts by weight abrasive grains. For the purpose of determining the above proportions, "binder" includes resins, fillers, grinding aids, etc.

Randomly shaped abrasive agglomerates of the invention may be made by first mixing at least a binder precursor and abrasive grains in a mixing vessel to form a homogeneous composition. The mixture should have a viscosity such that it is not excessively stiff or runny. After the mixing step is complete, the mixture is caused to solidify by curing the binder precursor by exposing the mixture to a form of energy, preferably heat or radiation. After the mixture is solidified, the mixture is crushed into agglomerates and graded. Useful devices for crushing the solid mass include conventional jaw crushers and roll crushers. Further details of making abrasive agglomerates are described in U.S. Pat. No. 4,799,939, incorporated herein by reference.

Precisely shaped agglomerate particles of the invention may be generally made by forming a mixture containing at least a binder precursor and abrasive grains, coating the mixture into precisely shaped cavities of a production tool, at least partially curing the binder precursor, and then removing the precisely shaped particles from the cavities of the production tool. The mixture can be formed using any conventional technique such as high shear mixing, air stirring, or tumbling. A vacuum can also be used during mixing so as to minimize air entrapment. The mixture may be introduced into the cavities of the production tool using techniques such as gravity feeding, pumping, die coating, or vacuum drop die coating. It is preferred to heat the mixture to a temperature of about 40° C. to about 90° C. to reduce the viscosity of the mixture so the mixture more readily flows into the cavity. The curable mixture is not only required to fill a portion of the cavity but preferably completely fills the cavity of the production tool so as to minimize imperfections in the resulting abrasive agglomerate. The mixture is partially cured by exposing the mixture to radiation or thermal energy while in the production tool cavity. The mixture may be post cured after the agglomerate particles are removed from the cavities. The formed agglomerate particles may be removed from the cavities by ultrasonic energy, a vacuum, an air knife, or combinations thereof. If the production tool is made of metal, the mixture can be removed by water jet or air jet. After the agglomerate particles are removed from the cavities, the particles may be transferred directly to a hopper, to a smooth roll and then removed, or directly to a carrier web. The mixture may be removed from the cavities as discrete particles or may be removed from the production tool as a sheet of interconnected agglomerate particles which are then separated. Further details for making precisely shaped agglomerate abrasive particles of the invention are described in U.S. Pat. No. 5,500,273 (Holmes), incorporated herein by reference.

Abrasive agglomerates for use in the abrasive articles of the invention are further described in U.S. Pat. Nos. 4,311,489 (Kressner) and 4,652,275 (Bloecher et al.).

Inorganic Particulates

Hard inorganic particulates are combined with a curable binder precursor to form a curable bond system of the invention. Useful binder precursors are described below.

The hard inorganic particulates useful in the abrasive articles of the invention should have a Mohs's Scale hardness of 5 or greater, preferably greater than 7, and more preferably greater than 8. In some instances, the Mohs's Scale hardness may be as high as 9.5.

The average particle size of the hard inorganic particulates can range from about 0.1 to 1,500 $\mu$m, typically between 1 and 500 $\mu$m, and even more generally between 5 and 500 $\mu$m. The size of the hard inorganic particulate is typically specified to be the longest dimension of the particulate. In most cases there will be a range distribution of particle sizes. In some instances, it is preferred that the particle size distribution be tightly controlled such that the resulting abrasive article provides a consistent surface finish on the workpiece being abraded.

Examples of conventional hard inorganic particulates include fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, ceria, zirconia, titania, silicates, tin oxide, cubic boron nitride, garnet, fused alumina zirconia, sol gel process derived alumina abrasive particles, and the like. Examples of sol gel process derived alumina abrasive particles can be found in U.S. Pat. Nos. 4,314,827 (Leitheiser et al.); 4,623,364 (Cottringer et al); 4,744,802 (Schwabel); 4,770,671 (Monroe et al.); and 4,881,951 (Wood et al.), all incorporated herein by reference.

Hard inorganic particulates can be coated with materials to provide the particles with desired characteristics. For example, materials applied to the surface of an inorganic particulate have been shown to improve the adhesion between the inorganic particulate and the binder. Additionally, a material applied to the surface of an inorganic particulate may improve the dispersibility of the inorganic particulates in the binder precursor. Alternatively, surface coatings can alter and improve the cutting characteristics of the resulting inorganic particulate. Such surface coatings are described, for example, in U.S. Pat. Nos. 5,011,508 (Wald et al.); 1,910,444 (Nicholson); 3,041,156 (Rowse et al.); 5,009,675 (Kunz et al.); 4,997,461 (Markhoff-Matheny et al.); 5,213,951 (Celikkaya et al.); 5,085,671 (Martin et al.); and 5,042,991 (Kunz et al.), the disclosures of which are incorporated herein by reference.

Binders

The curable bond systems of this invention comprise a mixture of hard inorganic particulates and a binder precursor. The curable bond system preferably contains an organic binder precursor. The binder precursors preferably are capable of flowing sufficiently so as to be able to coat a surface. Solidification of the binder precursor may be achieved by curing (e.g., polymerization and/or crosslinking), by drying (e.g., driving off a liquid), and/or simply by cooling. The binder precursor may be an organic solvent borne, a water-borne, or a 100 percent solids (i.e., a substantially solvent-free) composition. Both thermoplastic and/or thermosetting polymers, or materials, as well as combinations thereof, maybe used as binder precursors. Upon the curing of the binder precursor, the curable bond system is converted into the cured bond system. The preferred binder precursor may be either a condensation curable resin or an addition polymerizable resin. The addition polymerizable resins can be ethylenically unsaturated monomers and/or oligomers.

A curable bond system of the invention may comprise by weight, between about 1 part to 90 parts hard inorganic particulates and 10 parts to 99 parts binder precursor. Preferably, a bond system may comprise about 30 to 85 parts hard inorganic particulates and about 15 to 70 parts binder precursor. More preferably a bond system may comprise about 40 to 70 parts abrasive particles and about 30 to 60 parts binder precursor.

The bond systems of the invention are generally made by mixing hard, inorganic particulates into a binder precursor and then curing the binder precursor using means appropriate for the particular binder precursor.

The binder precursors are preferably a curable organic material (i.e., a monomer, oligomer, or material capable of polymerizing and/or crosslinking upon exposure to heat and/or other sources of energy, such as ultraviolet light, visible light, etc., or with time upon the addition of a chemical catalyst, moisture, or other agent which cause the polymer to cure or polymerize). Binder precursor examples include crosslinkable materials such as phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof. Other binder precursors include amino polymers or aminoplast polymers such as alkylated urea-formaldehyde polymers, melamine-formaldehyde polymers, and alkylated benzoguanamine-formaldehyde polymer, acrylate polymers including acrylates and methacrylates alkyl acrylates, acrylated epoxies, acrylated urethanes, acrylated polyesters, acrylated polyethers, vinyl ethers, acrylated oils, and acrylated silicones, alkyd polymers such as urethane alkyd polymers, polyester polymers, reactive urethane polymers, phenolic polymers such as resole and novolac polymers, phenolic/latex polymers, epoxy polymers such as bisphenol epoxy polymers, isocyanates, isocyanurates, polysiloxane polymers including alkylalkoxysilane polymers, or reactive vinyl polymers. The resulting binder may be in the form of monomers, oligomers, polymers, or combinations thereof.

There are two types of phenolic resins, resole and novolak. Resole phenolic resins have a molar ratio of formaldehyde to phenol of greater than or equal to one to one, typically between 1.5:1.0 to 3.0:1.0. Novolak resins have a molar ratio of formaldehyde to phenol of less than one to one.

Typical resole phenolic resins contain a base catalyst. The presence of a basic catalyst speeds up the reaction or polymerization rate of the phenolic resin. The pH of the phenolic resin is preferably from about 6 to about 12, more preferably from about 7 to about 10, and most preferably from about 7 to about 9. Examples of suitable basic catalysts include sodium hydroxide, potassium hydroxide, calcium hydroxide, magnesium hydroxide, barium hydroxide, and a combination thereof. Typical catalysts for the reaction of formaldehyde with phenol are chosen from group I and II metal salts, generally because of their high reactivity and low cost. Amines are also used to catalyze the phenol/aldehyde reaction. The preferred basic catalyst is sodium hydroxide. The amount of basic catalyst is preferably about 5 percent by weight or less, more preferably about 2 percent by weight or less, even more preferably about 1 percent by weight or less, and most preferably from about 0.5 percent by weight to about 0.9 percent by weight of the phenolic resin.

Resole phenolic resins usually are made from phenol and formaldehyde. A portion of the phenol can be substituted with other phenols such as resorcinol, m-cresol, 3,5-xylenol, t-butylphenol and p-phenylphenol. Likewise a portion of the formaldehyde can be substituted with other aldehyde groups such as acetaldehyde, chloral, butylaldehyde, furfural or acrolein. The general term "phenolic" includes phenol-formaldehyde resins as well as resins comprising other phenol-derived compounds and aldehydes. Phenol and formaldehyde are the most preferred constituents in the phenolic resin due to their high reactivity, limited number of side chain reactions and low cost. Resole phenolic and urea-aldehyde resins are preferably about 30 percent to about 95 percent solids, more preferably about 60 percent to about 80 percent solids, have a viscosity ranging from about 750 cps to about 1,500 cps (Brookfield viscometer, number 2 spindle, 60 rpm, 25° C.) before addition of any diluent, and have molecular weight (number average) of about 200 or greater, preferably varying from about 200 to about 700.

The phenolic resin preferably includes about 70 percent to about 85 percent solids, and more preferably about 72 percent to about 82 percent solids. If the percent solids is very low, then more energy is required to remove the water and/or solvent. If the percent solids is very high, then the viscosity of the resulting phenolic resin is too high which leads to processing problems. The remainder of the phenolic resin can be water and/or an organic solvent. More preferably, the remainder of the phenolic resin is water with substantially no organic solvent due to environmental concerns with both the manufacturing of phenolic resins and abrasive articles.

In addition to thermosetting polymers, thermoplastic binders may also be used. Examples of suitable thermoplastic polymers include polyamides, polyethylene, polypropylene, polyesters, polyurethanes, polyetherimide, polysulfone, polystyrene, acrylonitrile-butadiene-styrene block copolymer, styrene-butadiene-styrene block copolymers, styrene-isoprene-styrene block copolymers, acetal polymers, polyvinyl chloride, and combinations thereof.

Water-soluble binder precursors optionally blended with a thermosetting resin may be used. Examples of water-soluble binder precursors include polyvinyl alcohol, hide glue, or water-soluble cellulose ethers such as hydroxypropylmethyl cellulose, methyl cellulose or hydroxyethylmethyl cellulose. These binders are reported in U.S. Pat. No. 4,255,164 (Butkzc et al.), incorporated herein by reference.

In the case of binder precursors containing ethylenically unsaturated monomers and oligomers, polymerization initiators may be used. Examples include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, or mixtures thereof.

A suitable initiator system may include a photosensitizer. Representative photosensitizers may have carbonyl groups or tertiary amino groups, or mixtures thereof. Preferred photosensitizers having carbonyl groups are benzophenone, acetophenone, benzil, benzaldehyde, o-chlorobenzaldehyde, xanthone, thioxanthone, 9,10-anthraquinone, or other aromatic ketones. Preferred photosensitizers having tertiary amines are methyldiethanolamine, ethyldiethanolamine, triethanolamine, phenylmethyl-ethanolamine, or dimethylaminoethylbenzoate.

In general, the amount of photosensitizer or photoinitiator system may vary from about 0.01 to 10 percent by weight, more preferably from 0.25 to 4.0 percent by weight of the binder precursor.

Additionally, it is preferred to disperse (preferably uniformnly) the initiator in the binder precursor before addition of any particulate material, such as the inorganic particulates, abrasive grains, and/or filler particles.

Cationic initiators may be used to initiate polymerization when the binder is based upon an epoxy resin or vinyl ether functional resin. Examples of cationic initiators include salts of onium cations, such as arylsulfonium salts, as well as organometallic salts such as ion arene systems. Other examples are reported in U.S. Pat. Nos. 4,751,138 (Tumey et al.); 5,256,170 (Harmer et al.); 4,985,340 (Palazotto); and 4,950,696, all incorporated herein by reference.

Make Coat

The make coat is used for attaching or bonding the agglomerates to the backing of an embodiment of an abrasive article of the invention. The make coat is formed from curable binder precursors described above that are later cured. As used herein, the term "make coat" does not contain hard inorganic particulate as defined above. Preferred make coats of the invention include those comprising phenolic resins include the resole and phenolic resins described above.

Additives

The abrasive agglomerate particles, the bond systems, and the make coats of the invention may also contain additives such as fillers, grinding aids, fibers, lubricants, wetting agents, surfactants, pigments, dyes, coupling agents, platicizers, antistatic agents and suspending agents. Examples of fillers include wood pulp, vermiculite, and combinations thereof, metal carbonates, such as calcium carbonate, chalk, calcite, marl, travertine, marble, and limestone, calcium magnesium carbonate, sodium carbonate, magnesium carbonate; silica, such as amorphous silica, quartz, glass beads, glass bubbles, and glass fibers; silicates, such as talc, clays feldspar, mica, calcium silicate, calcium metasilicate, sodium aluminosilicate, sodium silicate; metal sulfates, such as calcium sulfate, barium sulfate, sodium sulfate, aluminum sodium sulfate, aluminum sulfate; gypsum; wood flour; aluminum trihydrate; metal oxides such as calcium oxide, aluminum oxide, titanium dioxide, and metal sulfites such as calcium sulfite.

A grinding aid is defined as particulate material the addition of which to an abrasive article has a significant effect on the chemical and physical processes of abrading thereby improving performance. In particular, it is believed that the grinding aid will (1) decrease the friction between the abrasive particles and the workpiece being abraded, (2) prevent the abrasive particles from "capping" by metal particles, (3) decrease the interface temperature between the abrasive particles and the workpiece, or (4) decrease the grinding forces. Examples of grinding aids include waxes, organic halide compounds, halide salts, and metals and their alloys. Examples or organic halides include chlorinated waxes such as tetrachloronapthalene, pentachloronapthalene, and poly vinylchloride. Examples of halide salts include sodium chloride, potassium cryolite, sodium cryolite, ammonium cryolite, potassium tetrafluoroborate, sodium tetrafluoroborate, and magnesium chloride. Examples of metals include tin, lead, bismuth, cobalt, antimony, cadmium, iron, and titanium. Other grinding aids include sulfur, organic sulfur compounds, graphite, and metallic sulfides.

Examples of coupling agents include organo-silanes, zircoaluminates, and titanates. Examples of antistatic agents include graphite, carbon black, conductive polymers, humectants, vanadium oxide, and the like. The amounts of these materials can be adjusted to provide the properties desired. The hard, inorganic particulates and/or abrasive grains may be pretreated with a coupling agent prior to mixing with the binder precursor. Alternatively, a coupling agent may be added directly into the binder precursor.

Abrasive articles of the invention may be made by first providing a backing having a front and back surface. Either a make coat precursor as defined herein or a first bond system precursor is applied to a surface of the backing by conventional means such as roll, transfer, knife, or die coating. Abrasive agglomerate particles are applied to the bonding medium by drop coating or electrostatic coating, preferably drop coating. The discreet abrasive agglomerate particles can be applied or placed randomly onto the backing. The bonding medium precursor is then at least partially solidified or cured to anchor the abrasive agglomerate particles to the backing. The bonding medium is typically at least partially solidified or cured from exposure to an energy source such as thermal or radiation energy. A second bond system precursor may be applied over the anchored abrasive agglomerate particles by conventional means. The second bond system precursor can be applied prior to or subsequent to solidification or curing of the abrasive agglomerate particle bonding medium using conventional means such as spraying or roll coating. Soft, rubber rolls are sometimes useful for roll coating. The second bond system further bonds the abrasive agglomerate particles to the backing. It is generally preferred that the hard inorganic particulates are uniformly dispersed within the binder precursor. Optionally, additional coatings or bond systems can be applied over the abrasive agglomerate particles and the second bond system.

Another aspect of this invention pertains to a method of abrading a workpiece. This method involves the step of bringing an abrasive article of the invention into frictional contact with a surface of the workpiece. The term "abrading" means that a portion of the metal workpiece is cut or removed by the abrasive article. Abrasive articles of the invention provide an enhanced cut when abrading a variety of workpieces. The workpiee may be any type of material such as metal, metal alloys, exotic metal alloys, ceramics, glass, wood, wood-like materials, composites, painted surface, plastics, reinforced plastics, stone or combinations thereof. A preferred workpiece is a steel workpiece. The workpiece may be flat or may have a shape or contour associated with it. Examples of workpieces include metal components, plastic components, particleboard, camshafts, crank shafts, furniture, turbine blades, and the like. The abrasive articles of the invention may be used in wet or dry applications.

Depending upon the application, there may be a liquid present during abrading. The liquid can be water, water containing conventional rust inhibiting compounds, or an organic compound, such as a lubricant, oil, soaps, cutting fluid, and the like. These liquids may also contain defoamers, degreasers, or the like.

Depending upon the application, the force at the abrading interface can range from about 0.345 $N/cm^2$ to over 689.5 $N/cm^2$. Generally, this range is from about 0.69 $N/cm^2$ to about 68.8 $N/cm^2$ of force at the abrading surface.

The abrasive articles of the invention may be used by hand or used in combination with a machine. At least one or both the abrasive article and the workpiccc is moved relative to the other when abrading. The abrasive articles of the invention can be converted into a belt, tape, roll, disc, or sheet, and the like. For belt applications, two free ends of the abrasive sheet are joined together using known methods and a splice is formed. A spliceless belt as described in U.S. Pat. No. 5,573,619 may also be used. Generally the endless abrasive belt traverses over at least one idler roll and a platen or contact wheel. The hardness of the platen or contact wheel is adjusted to obtain the desired rate of cut and workpiece surface finish. The speed of the abrasive belt ranges from about 60 to about 37,000 surface meters per minute, and generally between about 600 and about 3,700 surface meters per minute. The belt dimensions may range from about 5 mm to 1,000 mm wide and about 5 mm to 10,000 mm long. Abrasive tapes are continuous lengths of the abrasive article. They can range in width from about 1 mm to about 1,000 mm, generally from 5 mm to 250 mm. The abrasive tapes are usually unwound, traverse over a support pad that forces the tape against the workpiece and then rewound. The abrasive tapes can be continuously fed through the abrading interface and can be indexed. The abrasive disc, also called "daisies", can range in diameter from 50 mm to 1,000 mm. Typically, abrasive discs are secured to a back-up pad by an attachment means. These abrasive discs can rotate between 110 to 20,000 revolutions per minute, typically between 1,000 to 15,000 revolutions per minute.

EXAMPLES

The following non-limiting examples will further illustrate the invention. All parts, percentages, ratios, etc., in the examples are by weight unless indicated otherwise.

The following abbreviations and trade names described below in Table 1 were used throughout the examples.

TABLE 1

Material Designations

| Designation | Material |
|---|---|
| BAO | Brown fused aluminum oxide abrasive grit, commercially available from Treibacher Schleifmittel |
| CAB | Silicon dioxide, commercially available from Cabot Corporation, Cambridge, MA, under the trade designation "CAB-O-SIL" M5 |

TABLE 1-continued

| Designation | Material |
|---|---|
| $CACO_3$ | Calcium carbonate filler having an average particle size of about 15 μm |
| CRY | Sodium aluminum fluoride grinding aid particulate, commercially available from Washington Mills, Niagara Falls, NY |
| CAO1 | Ceramic aluminum oxide abrasive grain comprising alpha alumina, magnesia and rare earth oxide modifiers, commercially available from Minnesota Mining and Manufacturing Company, St. Paul, MN, under the trade designation "321 Cubitron" abrasive grain |
| KB1 | 2,2-dimethoxy-1,2-diphenylethanone, commercially available from Lamberti S.P.A., commercially available from Sartomer, Exton, PA, under the trade designation "ESACURE KB 1 |
| MSCA | 3-methacryloxypropyl-trimethoxy silane coupling agent, commercially available from Witco Corporation, Friendly, WV, under the trade designation "A-174" |
| OX-50 | Amorphous silica particles having an average surface area of 50 $m^2/g$, commercially available from DeGussa Corp., Richfield Park, NJ, under the trade designation "OX-50" |
| PRO | A mixture of 60/40/1 TMPTA/TATHEIC/KB1 |
| RPR | A resole phenolic resin having 75 percent solids in water, potassium hydroxide catalyzed and approximately 2,000 centipoise viscosity at 25° C. |
| TATHEIC | Triacrylate of tris(hydroxy ethyl) isocyanurate, commercially available from Sartomer, under the trade designation "Sartomer 368" |
| TMPTA | Trimethylolpropane triacrylate, commercially available from Sartomer, under the trade designation "Sartomer 351" |
| W | treated calcium metasilicate filler, commercially available from NYCO, Willsboro, NY, under the trade designation "WOLLASTOCOAT" |
| WAO | White aluminum oxide abrasive grit fused, commercially available from Treibacher Schleifmittel, Villach, Austria |

Measurement of the Surface Finish

The surface finish (Ra) of the test panels used in the examples was measured at the end of each abrasion test. Ra is the arithmetic average of the scratch depth in μm. Ra was measured using a Mahr Perthometer profilometer (Model M4P, available from Mahr Corporation, Cincinnati, Ohio).

Test Procedure 1

Wet Rocker Drum Test

The abrasive articles were converted into 10.2 cm by 15.2 cm sheets. These sheets of abrasive articles were then soaked for a minimum of 12 hours in water at room temperature prior to testing. These samples were installed on a cylindrical steel drum testing machine which oscillates (rocks) back and forth in a small arc creating a 1.3 cm by 10.1 cm wear path. The workpiece is essentially perpendicular to the abrasive article and in frictional contact therewith. The abrasive abraded the stationary Type 1018 carbon steel workpiece having dimensions of 1.3 cm by 1.3 cm by an initial height of 15.2 cm. There were approximately 60 strokes per minute on this wear path. The load applied to the workpiece via a lever arm was 3.6 kg. During testing, water was dropped onto each wear path at a rate of one drop per second to keep the sample damp. The total amount of carbon steel removed after 500 cycles (i.e., one cycle being one back-and-forth motion) was recorded as the total cut. The results are reported in the tables below as an average of four test specimens.

Test Procedure 2

The abrasive article was converted into a 7.6 cm by 203 cm endless belt and was installed on a constant rate reciprocating grinding machine (Thompson Type C12 grinding machine, available from Waterbury Farrel Technologies, Cheshire, Conn.) The effective cutting area of the abrasive belt was 2.54 cm by 203 cm. The workpiece abraded by these belts was 2.54 cm width by 17.8 cm length by 10.2 cm height. Abrading was conducted along the 2.54 cm by 17.8 cm face. The workpiece was mounted on a reciprocating table. Speed of the abrasive belt was 610 surface meters per minute. The table speed, at which the workpiece traversed, was 7.6 meters per minute. The downfeed increment of the abrasive belt was 2.54 μm/pass of the workpiece. The process used was conventional surface grinding wherein the workpiece was reciprocated beneath the rotating abrasive belt with incremental downfeeding between each pass. This grinding was carried out wet. Each belt was used until a normal force greater than 445 N was generated. At that point, the abrasive's useful life has been depleted. This test is designed to measure the lifetime of an abrasive belt when the belt is subjected to wet and constant-rate grinding conditions in metalworking applications.

Test Procedure 3

The abrasive article was formed into an endless belt. The belt was installed on the ACME flat-head finisher using the conditions described below in Table 2. The effective cutting area of the belt was 15×244 cm and the ground surface of the workpiece measured 15 cm×1.2 m. The workpieces were fed into the machine on a conveyor belt running at 10.7 m/min and the finish was measured after every $25^{th}$ workpiece is ground. The test is run until 1,500 feet (457 m) of workpiece sheets have been ground. The amount of material removed and the resulting finish is recorded and the abrading life left in the abrasive belt was estimated. The linear life estimate is based on the difference between the thickness of the backing and the amount of material left on the abrasive belt in the wear path compared to the thickness of the non-ground abrasive belt. A better estimate of abrasive belt life was determined under the conditions described below except that the workpieces are continuously fed into the machine until the cut rate is too low or the finish is no longer uniform and shows excessive variation.

TABLE 2

| | |
|---|---|
| Abrasive Belt Size | 30 cm × 244 cm |
| Machine | 30 cm (12 in)(ACME Flat-Head Finisher, ACME Manufacturing Co., Detroit, MI |
| Abrasive Speed | 1,311 surface m/min |
| Conveyor Speed | 10.7 m/min |
| Contact Wheel | 60A durometer, serrated 1:1 |
| Grinding Pressure | 0.2 amp/cm |
| Workpiece | 304 stainless steel sheets (15.2 cm × 1.2 m × ~ 0.3 cm) |
| Coolant | 5.5–6 percent Castrol Safety Kool 709 |

General Procedure for Preparing Precisely Shaped Agglomerate Particles

The precisely shaped agglomerate particles were prepared substantially as described in U.S. application Ser. No. 09/242,989, filed on Feb. 26, 1999, and entitled "ABRASIVE ARTICLE AND METHOD OF MAKING", also PCT Publication WO 98/10896, incorporated herein by reference. The precisely shaped particles were prepared on the apparatus similar to that illustrated in FIG. 8 of the above application, except that an ultrasonic horn was installed on the backside of the carrier web. A production tool was provided, in a continuous web form, that comprised a series of cavities with specified dimensions. These cavities were arranged in a predetermined order or array such that the production tool was essentially the inverse of the desired shape and dimensions of the precisely shaped agglomerate particles. The production tool was made from a polypropylene thermoplastic material that had been previously embossed by extruding the polypropylene material over a master tool. The nickel master tool also contained a series of cavities with specified dimensions and shape. The nickel master tool was made via a cutting knurl process. The production tool had a pattern of cavities in the form of pyramids having square bases and disposed such that the bases were butted up against each other. The height of the pyramid was about 810 μm and the base length of each side of the base was about 1,950 μm. The surface of the production tool containing the cavities is similar to the segment of the production tool shown in FIG. 6 of the above-identified patent application.

As the production tool left the unwind station at a tension of about 30 psi (300 Pa), a 51 μm thick polyester film carrier web left a second unwind station. The polyester film contained an ethylene acrylic acid copolymer primer. A binder precursor was applied by means of a knife over roll coater with a fixed gap of about 76 μm into the cavities of the production tool. The portion of the production tool containing the binder precursor was brought into contact with the carrier web by means of a nip roll that had a nip pressure of about 60 psi (600 Pa). The portion of the production tool containing the binder precursor and the carrier web was forced against a mandrel that rotated about an axis. Next, radiation energy was transmitted through the production tool and into the binder precursor. The source of the radiation energy was four ultraviolet lamps commercially available from Fusion Uv Systems Inc Gaithersburg, Md., that contained a "D" bulb and operated at 600 Watts/inch (240 watts/cm). Upon exposure to the energy source, the binder precursor was converted into a solidified, handleable binder. Both the production tool containing the solidified, handleable binder and the carrier web were continuously moved through the curing zone by means of the mandrel. The carrier web was separated from the production tool containing the binder in the vicinity of a nip roll. An ultrasonic horn (Model 108, commercially available from Branson Ultrasonics Corp., Danbury, Conn.) was placed directly behind the carrier web. The ultrasonic horn operated on high and helped to facilitate the removal of the particles from the carrier web. Next, the carrier web was rewound on a rewind station at a tension pressure of about 100 psi (1,000 Pa). This was a continuous process that operated at about 130 feet per minute (40 m/min) to 180 feet per minute (55 m/min).

These agglomerate particles were removed from the carrier web in one of two manners, i.e., as discrete particles or as a sheet of particles. These discrete particles also included doublets or triplets of individual particles. It was preferred to remove the particles as discrete particles. If 25 percent or less of the particles were removed from the carrier web as sheets of particles, then the resulting particles (including discrete particles and particle sheets) were first screened to separate the discrete particles from the particle sheets. Then the particle sheets were ball milled in a cement mixer using steel or ceramic slugs. The slugs were one inch (2.54 cm) long by three-quarter inch (1.9 cm) diameter. Care was taken during ball milling to avoid damage to the discrete particles. After ball milling, the particles were screened a second time. If about 25 percent or more of the particles were removed from the carrier web as sheets of particles, then the resulting particles were ball milled in a manner similar to that described above. After ball milling, the particles were screened.

General Procedure for Preparing Coated Abrasive Articles

The method to make the coated abrasive articles of the examples was continuous and the resulting web of coated abrasive was converted into an endless, spliced abrasive belt by conventional means. The backings were conventional Y weight polyester cloth with a sateen weave. This cloth backing was conventionally treated with phenolic and phenolic/latex cloth treatments to seal the backing and to enhance the physical characteristics of the backing. A make coat was applied to the front surface of the backing. The make coat precursor used was a conventional calcium carbonate filled resole phenolic resin (48 percent resin, 52 percent $CaCO_3$) and the make coat coating weight was about 290 grams/square meter. The precisely shaped abrasive agglomerate particles were drop coated into the make coat or bond system precursor. The resulting construction was heated to partially cure the resole phenolic resin. Next, a bond system precursor or a conventional size coat precursor was coated over the abrasive particles. The size coat precursor was a conventional calcium carbonate filled resole phenolic resin (48 percent resin, 52 percent $CaCO_3$). All of the resulting coated abrasive articles were flexed prior to testing. All of the coating weights below are expressed as wet coating weights. The process conditions are summarized in the Table 3 below.

TABLE 3

| | |
|---|---|
| Line Speed (m/min) | 23 |
| Make Coating Method | Squeeze Roll |
| Mineral Coating Method/s | Drop |
| Make Precure Conditions | 20 min @ 185° F. (85° C.), 70 min @ 195° F. (91° C.) |
| Size/Bond System Cure Conditions | 40 min @ 175° F. (85° C.), 70 min @ 195° F. (91° C.) |
| Final Cure Conditions | 11 hrs @ 210° F. (99° C.) |
| Flex Requirements | 254 cm Supported |

Examples 1 and 2

A slurry formulation for preparing precisely shaped abrasive agglomerate particles was prepared from 15.6 parts by weight premix (Table 4 below), 7.2 parts by weight grade P100 WAO, and 7.2 parts by weight grade P320 WAO, using the General Procedure for Preparing Precisely Shaped Agglomerate Particles. The abrasive articles were prepared according to the General Procedure for Preparing Coated Abrasive Articles above.

For Example 1, the bond system applied over the abrasive agglomerates contained grade 120 BAO inorganic particulate while the bond system for Example 2 used grade 150 BAO inorganic particulate. Table 5 shows the general formulation of the bond systems used.

The endless belts of Examples 1 and 2 were run wet according to Test Procedure 2 with a downfeed of 1 mil/pass (25.4 μm/pass). The endless belts of Examples 1 and 2 were run to a normal force of greater than 445 N endpoint. The endless belts of Example 1 lasted 444 passes while the endless belts of Example 2 lasted 374 passes. These results indicate that coarser inorganic particulates in the bond system provide longer abrading performance than finer inorganic particulates in the bond system.

TABLE 4

Premix

| Ingredient | Parts by Weight |
|---|---|
| PRO | 54.8 |
| KB1 | 0.27 |
| MSCA | 2.73 |

TABLE 4-continued

| Premix | |
|---|---|
| Ingredient | Parts by Weight |
| OX-50 | 1.1 |
| W | 41.1 |

TABLE 5

| Ingredients | Parts by Weight |
|---|---|
| RPR | 12,800 |
| BAO | 6,400 |
| OX-50 | 255 |
| Water | 865 |

Comparative Example A and Examples 3 and 4

Comparative Example A was constructed as described in the General Procedure for Preparing Coated Abrasive Articles above and is the same construction as Example 1 except a size coating consisted of RPR and calcium carbonate was used instead of the bond system. Example 3 was prepared as in Example 1 using the bond system formulation shown in Table 6. Example 4 was identical to Example 3 except that an additional bond system (identical to the bond system of Example 3) was coated over the bond system of Example 3. In other words, the first bond system functioned as a "size" coat and the second bond system functioned as a "supersize" coat.

TABLE 6

| Ingredients | Parts by Weight |
|---|---|
| RPR | 863 |
| BAO (Grade 100) | 984 |
| Water | 153 |
| OX-50 | 25.8 |

Test Procedure 1 was performed on Comparative Example A and Examples 3 and 4 using a total of 3,000 strokes to determine cut performance. Comparative Example A cut 0.58 g, Example 3 cut 1.24 g, and Example 4 cut 1.07 g. The results show that the use of the bond system in Example 3 resulted in more than doubling the total cut compared with Comparative Example A having no abrasive mineral in the size coat. Example 4 did not perform as well as Example 3, probably due to overbonding with the second bond system; the low pressure used on this test apparently did not break down the second bond system to expose the abrasive agglomerates.

Test Procedure 2 was also run on Comparative Example A and Examples 3 and 4 at 25.4 μm/pass downfeed. The results were that Comparative Example A lasted 210 passes, Example 3 lasted 521 passes, and Example 4 lasted 639 passes. These results show the dramatic improvement of the bond system of Example 3 compared with the conventional size coat of Comparative Example A. Example 4 also performed better than Comparative Example A.

Examples 5–7

Examples 5–7 were prepared as described for Examples 1 and 2 using the bond system formulation shown in Table 7 with a phenolic solids to mineral ratio of 35:65. Example 5 utilized grade 100 BAO in the bond system, Example 6 used grade 80 BAO in the bond system, and Example 7 used grade 60 BAO in the bond system.

TABLE 7

| Ingredients | Parts by Weight |
|---|---|
| RPR | 780 |
| BAO | 1100 |
| Water | 20 |
| OX-50 | 23.4 |

Examples 5–7 were tested according to Test Procedure 1 at 3,000 strokes. The results were as follows: Example 5, 0.93 g; Example 6, 0.90 g; Example 7, 1.29 g. Examples 5–7 were also tested according to Test Procedure 2. The results were as follows: Example 5 lasted 586 passes, Example 6 lasted 1,015 passes, and Example 7 was still cutting at about 223 N normal force at 1,200 passes when the test was stopped. The results of Test Procedure 2 indicate that coarser inorganic particulate in the bond system improves cutting longevity and therefor improves life.

Comparative Example B and Examples 8–9

Comparative Example B was made as described in the General Procedure above. Example B was prepared as in Example 8 except a size coating consisted of RPR and calcium carbonate was used instead of the bond system. Example 8 was prepared as in Example 1 using a bond system having the formulation: 9,200 g RPR, 270 g of OX-50 for Example 8, 1,650 g of water and 13,000 g of Grade 180 WAO. Example 9 was prepared as in Example 8 except that 205 g of CAB was substituted for the OX-50. Coating weights for Comparative Example B and Examples 8–9 are shown in Table 8.

Comparative Example B and Examples 8 and 9 were tested according to Test Procedure 3. The total cut was based on 1,500 lineal feet (457 m) of stainless steel sheets. The results showed that Examples 8 and 9 have a much higher cut rate, longer estimate life, and provided a coarser finish when compared with Comparative Example B. The final caliper of the abrasive samples was measured with a hand held μm. The percent of abrasive belt sample used was based on belt caliper data. A final caliper of 0.0635 mm (0.0025 inch) for the YF backing was assumed. Subsequent wear out testing showed that the abrasive belts have much more abrasion life than a linear estimate gives. The wear out test continued to grind the belt until the cut rate reaches an unacceptable rate or the finish is no longer consistent. The results are shown in Table 9 below.

TABLE 8

| | Comp.Ex. B ($g/m^2$) | Example 8($g/m^2$) | Example 9($g/m^2$) |
|---|---|---|---|
| Backing | 437 | 437 | 437 |
| Make | 289 | 289 | 289 |
| Abrasive Agglomerate Size/Bond System | 733 | 733 | 733 |
| | 666 | 800 | 837 |

TABLE 9

| Test Belt Description | Total Cut - g (Percent) | Ra Finish - (μm) (start > end) | Final Caliper (mm) | Percent of Belt used* |
|---|---|---|---|---|
| Comparative Example B | 1,175 | 1.32 > 1.03 | 0.94 | 76.0 |
| Example 8 | 1,718 (46 percent more) | 1.55 > 1.14 | 1.19 | 56.0 |
| Example 9 | 1,778 (51 percent more) | 1.61 > 1.11 | 1.24 | 52.0 |

*Based on belt caliper

Examples 10–12

Examples 10–12 were prepared according to the General Procedure for Preparing Abrasive Articles. The coating weights for Examples 10–12 are shown in Table 10 below and the bond system formulations are shown in Table 11. A slurry formulation for preparing precisely shaped abrasive agglomerate particles was prepared from 15.9 parts by weight premix (Table 4 prior), 4.7 parts by weight grade F360 WAO, and 9.4 parts by weight grade P150 WAO for Examples 10 & 11 and 9.4 parts by weight grade P150 BAO for Example 12, using the General Procedure for Preparing Precisely Shaped Agglomerate Particles.

Examples 10–12 were tested according to Test Procedure 3. The results are shown in Table 12. Data for Total Cut and Ra Finish is shown for 1,500 (457 m) and 6,000 (1,829 m) linear feet of workpiece. Example 10 has lower cut than Examples 11 and 12. The finish of the Example 10 with grade 220 BAO in the bond system was similar to the finish of Example 11 with the grade 150 BAO in the bond system. The WAO in the precisely shaped abrasive agglomerate particles of Example 11 resulted in a finer finish than the BAO in the precisely shaped abrasive agglomerate particles of Example 12.

TABLE 10

| | Example 10 ($g/m^2$) | Example 11 ($g/m^2$) | Example 12 ($g/m^2$) |
|---|---|---|---|
| Make | 293 | 293 | 310 |
| Abrasive Agglomerate | 680 | 680 | 733 |
| Bond System | 900 | 864 | 766 |

TABLE 11

| Raw Material | Example 10 (g) | Examples 11–12 (g) |
|---|---|---|
| RPR | 9200 | 9200 |
| CAB | 169 | 169 |
| Water | 1650 | 1650 |
| Grade 220 WAO | 13000 | |
| Grade 150 WAO | | 13000 |

TABLE 12

| Test Belt Description | Total Cut (g) 457 m, 1829 m | Ra Finish @ 1829 m (μm) (Start > End) | Ra Finish @ 457 m (μm) (Start > End) | Percent of Belt used |
|---|---|---|---|---|
| Example 12 | 1575 | | 1.55 > 1.09 | |
| Example 13 | 1894, 6708 | 1.56 > 1.07 | 1.56 > 1.10 | 100 percent |
| Example 14 | 1898 | | 1.75 > 1.24 | Unknown |

Various modifications and alterations of this invention will become apparent to those skilled in the art without departing from the scope and spirit of the invention, and it should be understood that this invention is not to be unduly limited to the illustrated embodiments set forth herein.

What is claimed is:

1. An abrasive article comprising:

a backing having a front and back surface;

a bond system which comprises a second binder and a plurality of hard, inorganic particulates dispersed in the second binder; and a plurality of discrete abrasive agglomerate particles bonded to the front surface of the backing by means of the bond system, wherein the abrasive agglomerate particles comprise a plurality of individual abrasive grains bonded together by a first binder, and wherein the average particle size of the abrasive grain is essentially the same size as the average particle size of the hard, inorganic particulates.

2. The abrasive article according to claim 1 wherein the abrasive grains are selected from the group consisting of fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, zirconia, titania, silicates, tin oxide, cubic boron nitride, garnet, fused alumina zirconia, sol gel process derived alumina abrasive particles, and combinations thereof.

3. The abrasive article according to claim 1 wherein the average particle size of the abrasive grains is within 20 percent of the average particle size of the hard, inorganic particulates.

4. The abrasive article according to claim 1 wherein the hard, inorganic particulates have a Mohs' Scale hardness of 5 or greater.

5. The abrasive article according to claim 1 wherein the hard inorganic particulates are selected from the group consisting of fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, ceria, zirconia, titania, silicates, tin oxide, cubic boron nitride, garnet, fused alumina zirconia, sol gel process derived alumina abrasive particles, and combinations thereof.

6. The abrasive article according to claim 1 wherein the second binder is selected from the group consisting of phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, and mixtures thereof.

7. The abrasive article according to claim 1 wherein the bond system comprises by weight, about 1 part to 90 parts hard inorganic particulates and 10 parts to 99 parts binder.

8. An abrasive article comprising:

a backing having a front and back surface;

a make coat bonded to the front surface of the backing;

a plurality of abrasive agglomerate particles bonded to the front surface of the backing by means of the make coat, wherein the abrasive agglomerate particles comprise a plurality of individual abrasive grains bonded together by a first binder; and a bond system applied over the abrasive agglomerates, wherein the bond system comprises a second binder and a plurality of hard, inorganic particulates dispersed within the second binder, and wherein the average particle size of the abrasive grain is essentially the same size as the average particle size of the hard, inorganic particulates.

9. The abrasive article according to claim 8 wherein the abrasive grains are selected from the group consisting of fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, zirconia, titania, silicates, tin oxide, cubic boron nitride, garnet, fused alumina zirconia, sol gel process derived alumina abrasive particles, and combinations thereof.

10. The abrasive article according to claim 8 wherein the average particle size of the abrasive grains is within 20 percent of the average particle size of the hard, inorganic particulates.

11. The abrasive article according to claim 8 wherein the hard, inorganic particulates have a Mohs' Scale hardness of 5 or greater.

12. The abrasive article according to claim 8 wherein the hard inorganic particulates are selected from the group consisting of fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, ceria, zirconia, titania, silicates, tin oxide, cubic boron nitride, garnet, fused alumina zirconia, sol gel process derived alumina abrasive particles, and combinations thereof.

13. The abrasive article according to claim 8 wherein the second binder is selected from the group consisting of phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, and mixtures thereof.

14. The abrasive article according to claim 8 wherein the bond system comprises by weight, about 1 part to 90 parts hard inorganic particulates and 10 parts to 99 parts binder.

15. An abrasive article comprising:

a backing having a front and back surface;

a plurality of discrete abrasive agglomerate particles bonded to the front surface of the backing, wherein the abrasive agglomerate particles comprise a plurality of individual abrasive grains bonded together by a first binder;

a first bond system that bonds the abrasive agglomerate particles to the front surface of the backing, wherein the first bond system comprises a second binder and a plurality of hard inorganic particulates dispersed in the second binder; and a second bond system applied over the abrasive agglomerate particles, wherein the second bond system comprises a third binder and a plurality of hard inorganic particulates dispersed in the third binder, and wherein the average particle size of the abrasive grain is essentially the same size as the average particle size of the hard, inorganic particulates.

16. The abrasive article according to claim 15 wherein the abrasive grains are selected from the group consisting of fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, zirconia, titania, silicates, tin oxide, cubic boron nitride, garnet, fused alumina zirconia, sol gel process derived alumina abrasive particles, and combinations thereof.

17. The abrasive article according to claim 15 wherein the average particle size of the abrasive grains is within 20 percent of the average particle size of the hard, inorganic particulates.

18. The abrasive article according to claim 15 wherein the hard, inorganic particulates have a Mohs' Scale hardness of 5 or greater.

19. The abrasive article according to claim 15 wherein the hard inorganic particulates of the second bond system are selected from the group consisting of fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, ceria, zirconia, titania, silicates, tin oxide, cubic boron nitride, garnet, fused alumina zirconia, sol gel process derived alumina abrasive particles, and combinations thereof.

20. The abrasive article according to claim 15 wherein the second and third binder is selected from the group consisting of phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, and mixtures thereof.

21. The abrasive article according to claim 15 wherein the bond systems comprise by weight, about 1 part to 90 parts hard inorganic particulates and 10 parts to 99 parts binder.

22. A method of making an abrasive article comprising the steps of:

placing a make coat precursor on a surface of a backing;

placing discreet abrasive agglomerate particles onto the make coat precursor, the abrasive agglomerate particles comprising a plurality of individual abrasive grains bonded together by a first binder;

applying a bond system precursor over the abrasive agglomerate particles, said bond stem comprising a plurality of hard inorganic particulates dispersed in a second binder precursor, wherein the average particle size of the abrasive grain is essentially the same as the average particle size of the hard inorganic particulates; and curing the make coat and second bond precursor.

23. The method according to claim 22 further comprising the step of at least partially hardening or curing the make coat precursor from exposure to an energy source before the step of applying the bond system.

24. A method of abrading a surface of a workpiece comprising the step of:

frictionally contacting a surface of an abrasive article with a surface of the workpiece, the abrasive article comprising a backing having a front and back surface;

a plurality of discrete abrasive agglomerate particles bonded to the front surface of the backing, wherein the abrasive agglomerate particles comprise a plurality of individual abrasive grains bonded together by a first binder; and a bond system that bonds the abrasive agglomerate particles to the front surface of the backing, wherein the bond system comprises a second binder and a plurality of hard, inorganic particulates dispersed in the second binder, and wherein the average particle size of the abrasive grain is essentially the same size as the average particle size of the hard, inorganic particulates.

* * * * *

UNITED STATES PATENT AND TRADEMARK OFFICE

CERTIFICATE OF CORRECTION

PATENT NO. : 6,056,794
DATED : May 2, 2000
INVENTOR(S) : Stoetzel et al.

It is certified that error appears in the above-identified patent and that said Letters Patent is hereby corrected as shown below:

Column 8,
Line 58, "urea-formaldchyde" should read -- urea-formaldehyde --.

Column 10,
Line 13, "Butkzc" should read -- Butkze --.
Line 36, "uniformnly" should read -- uniformly --.

Column 12,
Line 1, "workpiee" should read -- workpiece --.
Line 23, "workpiccc" should read -- workpiece --.

Column 21,
Line 55, "acrylatcd" should read -- acrylated --.

Signed and Sealed this

Twelfth Day of March, 2002

*Attest:*

*Attesting Officer*

JAMES E. ROGAN
*Director of the United States Patent and Trademark Office*